US005285027A

United States Patent [19]

Nakamura et al.

[11] Patent Number: 5,285,027

[45] Date of Patent: Feb. 8, 1994

[54] HYDRAULIC ELEVATOR AND A CONTROL METHOD THEREOF

[75] Inventors: Ichiro Nakamura, Katsuta; Haruo Watanabe, Chiyoda; Tsuyoshi Ogasawara, Ishioka; Katsuharu Shuto, Chiyoda; Eiichi Sasaki, Katsuta, all of Japan

[73] Assignee: Hitachi, Ltd., Tokyo, Japan

[21] Appl. No.: 843,163

[22] Filed: Feb. 28, 1992

[30] Foreign Application Priority Data

Feb. 28, 1991 [JP] Japan ..... 3-34042

[51] Int. Cl.[5] ..... B66B 1/04

[52] U.S. Cl. ..... 187/29.2; 187/17; 187/109; 187/110; 187/111; 187/118

[58] Field of Search ..... 187/29.2, 109, 110, 187/111, 116, 117, 17, 118

[56] References Cited

U.S. PATENT DOCUMENTS

| | | | |
|---|---|---|---|
| 3,977,497 | 8/1976 | McMurray | 187/17 |
| 4,674,527 | 6/1987 | Fossati | 137/115 |
| 4,694,935 | 9/1987 | Lawrence | 187/110 |
| 4,715,478 | 12/1987 | Nakamura et al. | 187/111 |
| 4,775,031 | 10/1988 | Nakamura et al. | 187/111 |
| 4,800,990 | 1/1989 | Blain | 187/17 |
| 5,014,824 | 5/1991 | Fargo | 187/17 |
| 5,048,644 | 9/1991 | Pelto-Huikko | 187/17 |
| 5,082,091 | 1/1992 | Fargo | 187/17 |
| 5,156,080 | 10/1992 | Pelto-Huikko | 91/461 |

FOREIGN PATENT DOCUMENTS

| | | | |
|---|---|---|---|
| 57-81073 | 5/1982 | Japan | B66B 1/26 |
| 4-39278 | 2/1992 | Japan | 187/110 |

*Primary Examiner*—Steven L. Stephan
*Assistant Examiner*—Thomas M. Dougherty
*Attorney, Agent, or Firm*—Antonelli, Terry, Stout & Kraus

[57] ABSTRACT

A hydraulic elevator comprises a car, a hydraulic jack to drive the car, a hydraulic pump, and control means for controlling a flow rate of fluid flowing to or from the hydraulic jack thereby to control movement of the car. The control means comprises a main valve constructed so as to allow fluid the flow from the pump into the hydraulic jack when a pressure of the fluid is higher than a predetermined value thereby to effect upward running of the car, and to check a fluid flow from the hydraulic jack when the pressure of the fluid from the pump is less than the predetermined value, and valve control means including a plurality of pilot valves for controlling, when the pressure of the fluid from the pump is less than the value, the main valve to open and close, and wherein the valve control means controls the closing operation of the main valve along at least two different patterns.

27 Claims, 15 Drawing Sheets

HYDRAULIC ELEVATOR AND A CONTROL METHOD THEREOF

BACKGROUND OF THE INVENTION

The present invention relates to a hydraulic elevator in which a car is controlled by a control of a flow rate of fluid flowing to or from a hydraulic jack for driving the car through a control of rotational speed of a hydraulic pump, and to a control method thereof.

In this kind of hydraulic elevator, there is a known method of controlling a flow rate of pressurized fluid through a control of rotational speed of a hydraulic pump according to a speed instruction by an electric motor. In particular, as electric control apparatus and control technique progress, a control of rotational speed through control of a motor by an invertor has been easy and reliability of such a hydraulic elevator that a rotational speed thereof is controlled by an inverter-driven motor has been raised. In this kind of conventional hydraulic elevator, its main point is a speed control so as to carry out smooth running of a car. In the elevator, a fluid control valve is required to provide excellent comfort for a of person in the car, to reduce pressure loss in usual running and to provide all safety functions, such as keeping the car at the stop position by rapid closing of the fluid control valve immediately after the car stops.

Thus, the fluid control valve has been required of various functions. An example of such hydraulic elevator is disclosed in JP A 57-81073(1982).

In a hydraulic elevator in which the present invention is applicable, safety security of the car depends on a fluid control valve. In normal running, the fluid control valve is closed rapidly to prevent the car from sinking due to fluid leakage at the hydraulic pump after the car stops. On the other hand, the car may run at a higher speed than an allowable limit when the hydraulic pump is driven at a higher speed than a rated speed due to a control apparatus error or when the pump has no power supplied thereto due to a power failure. In such a case, the car should stop safely at a shortest distance from a position that the car is braked, with a small braking shock.

Even during emergency, different functions are required for the control valve to control the speed of the car during the emergency. When the car is running at a high speed, rapid closing of the control valve increases braking shock. Therefore, the control valve is required to close at a suitable speed. Since breaking occurs abruptly, persons in the car cannot brace themselves for protection. Accordingly, the braking shock should be reduced to prevent the risk of injury.

When the car runs at a relatively low speed, rapid closing of the control valve is required to prevent acceleration of the car due to release of the braking force or to shorten the braking distance. In particular, since a door of the car is opened during leveling of the car to the floor, it is necessary to drastically shorten the braking distance.

As mentioned above, the control valve has specific characteristics for normal operation and emergencies, with the characteristics during an emergency depending on the car operating sped at the time of the emergency.

SUMMARY OF THE INVENTION

An object of the invention is to provide a hydraulic elevator in which a downward running speed of the car is able to decrease rapidly and safely, and also stop with a minimal braking distance producing only a small braking shock, whereby a person in the car can ride comfortably and be assured of utmost safety and reliability, and a control method of the hydraulic elevator.

The present invention resides in a hydraulic elevator comprising a car, a hydraulic jack to drive the car, a hydraulic pump, and control means for controlling a flow rate of fluid flowing to or from the hydraulic jack to thereby control movement of the car. The control means comprises a main valve constructed so as to allow fluid from the pump to flow into the hydraulic jack when pressure of the fluid is higher than a predetermined value to thereby effect upward running of the car, and to check a fluid flow from the hydraulic jack when the pressure of the fluid from the pump is less than the predetermined value. The control means also comprises valve control means including a plurality of pilot valves for controlling, when the pressure of the fluid from the pump is less than the predetermined value, the opening and closing of a main valve, wherein the valve control means controls the closing operation of the main valve along at least two different patterns.

According to an aspect of the invention, one of the patterns for closing the main valve is such that the opening of the main valve decreases as a downward running speed of the car decreases and, furthermore, closes rapidly during an emergency.

According to another aspect of the invention, a closing rate of the main valve at an emergency is changeable. For example, the main valve closing rate is large when the opening of the main valve is large and smaller when the opening is smaller.

According to a further aspect of the invention, one of the closing patterns of the main valve is to initially close the main valve at a high rate and changing to a lower closing rate when the car runs at a high speed. Another pattern closes the main valve at a fixed rate when the car runs at a lower speed, for example, near stoppage of the car.

Other aspects of the invention will be seen from the following description of embodiments referred to the drawings.

According to the invention, for example, since the main valve can be closed rapidly immediately after the car stops during usual downward operation, the car can keep the stop position constant, ensuring safety for persons in the car. Further, during an emergency such as power failure, closing operation of the main valve can be changed from rapid closing to slow closing (two step rates or speeds) or the closing operation is rapidly effected, depending on downward speed of the car.

DETAILED DESCRIPTION OF EMBODIMENTS OF THE INVENTION

An embodiment of a hydraulic elevator according to the invention will be described hereunder, referring to FIGS. 1A to 3.

Figure 1A:
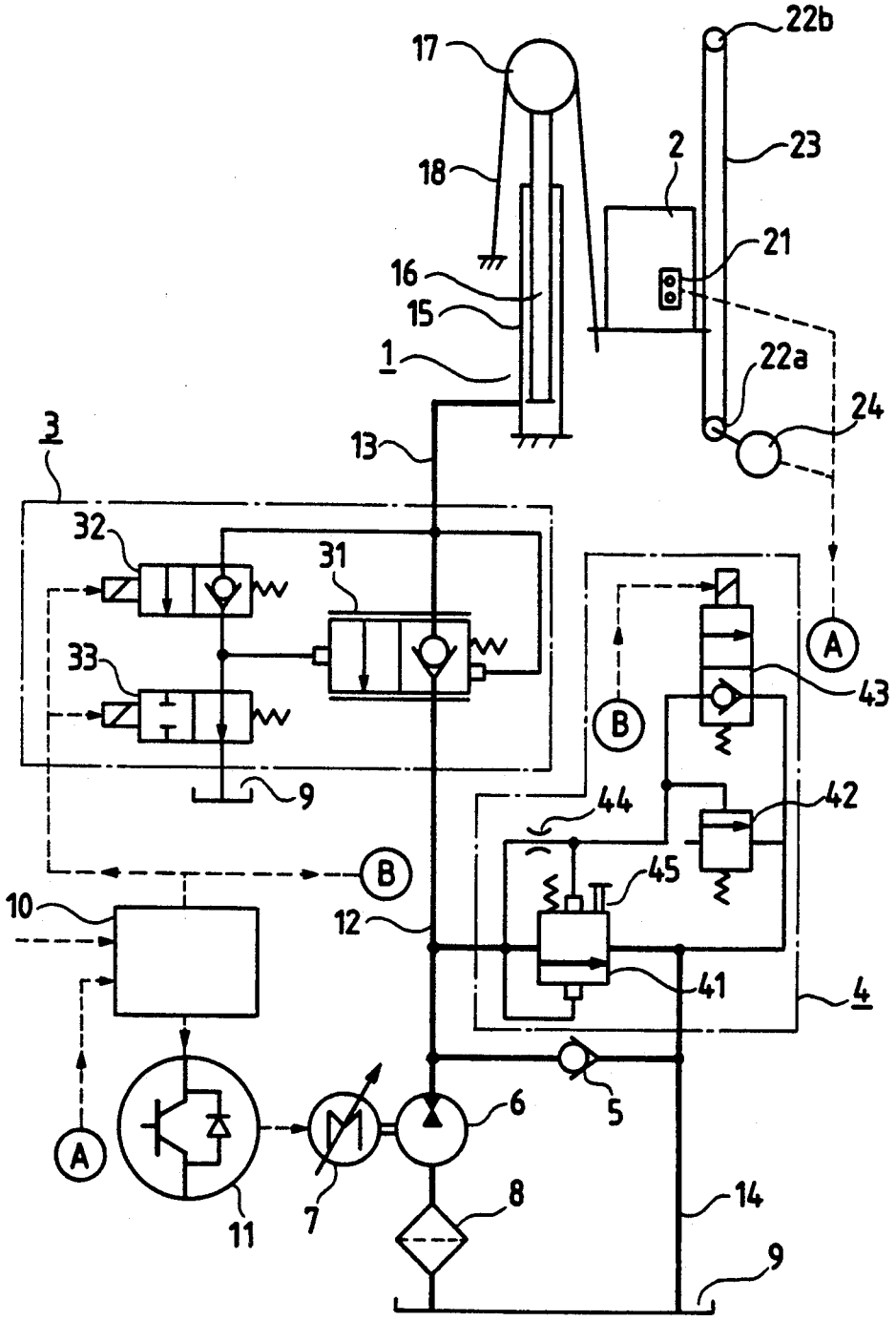
FIG. 1A is a schematic diagram of an embodiment of a hydraulic elevator according to the invention.

In FIG. 1A, the hydraulic elevator comprises a car 2, a hydraulic jack 1, to drive the car 2 directly or indirectly, a fluid control valve 3, a relief valve 4 with an unload function, a suction valve 5 for protection of a pump, a hydraulic pump 6 which is reversible in rotation, a motor 7 connected to the pump 6 to drive the same and driven by an inverter 11, and a control apparatus 10 for controlling fluid valves and the inverter 11.

The hydraulic jack 1 comprises a hydraulic cylinder 15 and a plunger 16.

The jack 1 drives the car 2 via a pulley 17 mounted on the top of the plunger 16 and a rope 18 engaged with the pulley 17.

The elevator is provided with a push button 21 mounted on the car 2 for operation instruction and a detector unit for detecting the position and/or running speed of the car 2 according to the number of revolutions and/or revolutional speed. The detector unit comprises a pair of pulleys 22*a*, 22*b* vertically distant from each other, a rope or belt 23 arranged on the pulleys 22*a*, 22*b* in an endless fashion and connected to the car 2 so that the belt moves together with the car 2, and a detector 24. Running movement of the car 2 is transmitted to the pulley 22*a* as rotation thereof via the belt 23. The rotation is detected by the detector 24, and translated the position and/or the running speed of the car 2. Signals from the detector 24 and the push button 21 are transmitted to the controller 10.

The control valve 3 comprises a main valve 31, a plurality of pilot valves 32, 33 to form a pilot operation type check valve. The main valve 31 is constructed so as to allow fluid to flow to the hydraulic jack 1 and to check a counter fluid flow from the hydraulic jack 1. The closed main valve 31 is forcibly opened by the pilot valves 32, 33 given an instruction and its opening also is controlled by the pilot valves.

The relief valve 4 comprises a main valve 41, a pilot relief valve 42, a pilot change-over valve 43, a throttle 44, and a stopper 45. The relief valve 4 sets pressure in a flow path 12 between the pump 6 and the control valve 3 according to a set pressure of the pilot-relief valve 42 and sets the pressure in the flow path 12 to an unloading pressure by energizing the pilot change-over valve 43. The suction valve 5 prevents the flow path 12 from becoming vacuum higher than a certain value to thereby prevent the pump 6 from being broken.

Figure 1B:
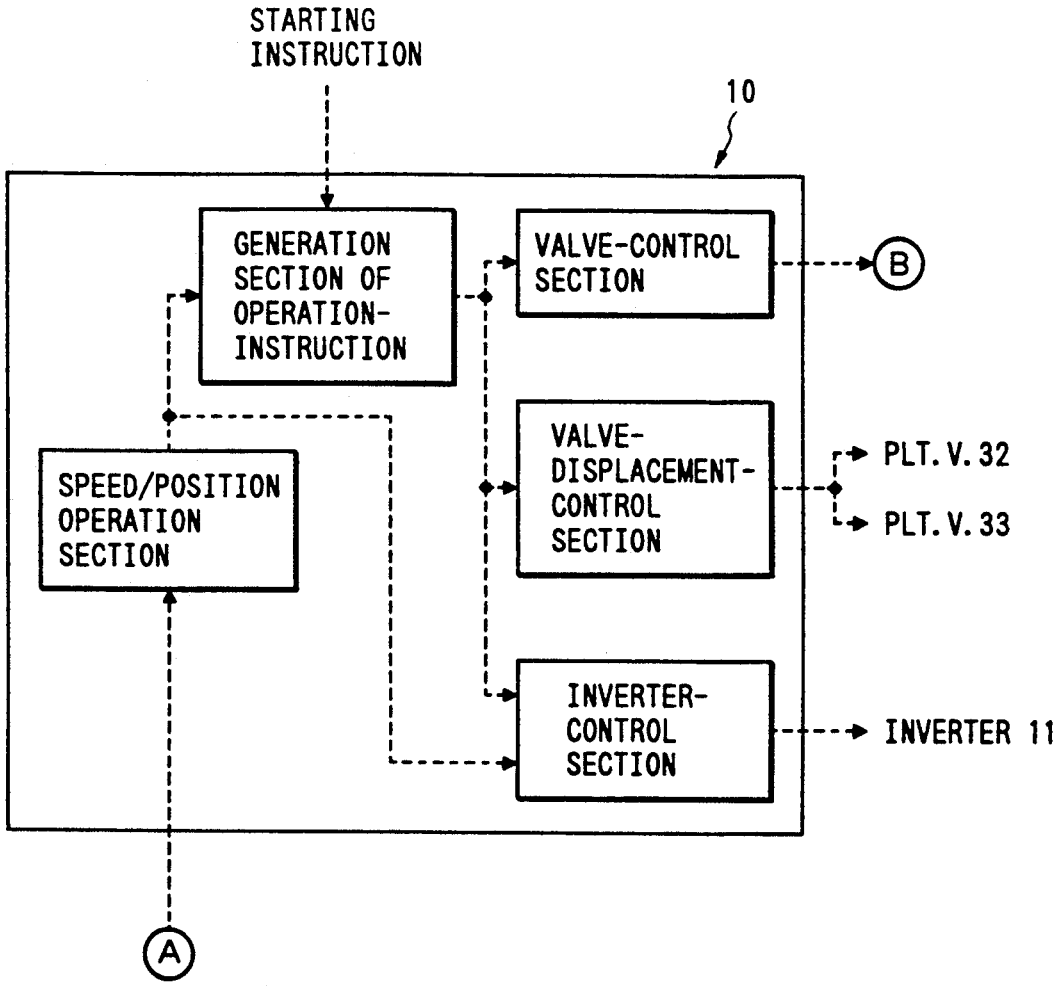
FIG. 1B is a block diagram of a control apparatus used in FIG. 1B.

The controller 10, as shown in FIG. 1B, comprises a speed and/or position operation section, an operation-instruction generation section, a valve control section, a valve displacement control section and an inverter-control section. The speed/position operation section processes signals from the detector 24 to obtain the real speed and position of the car 2. The operation-instruction generation section generates total instructions such as an elevator designation, driving operation, deceleration, stop, etc. by calling from the car 2 to control the valve control section, the inverter control section and the valve displacement control section. The inverter control section drives the inverter 11 to control the motor 7. The valve displacement control section controls various pilot valves such as pilot valves 32, 33 to thereby open and close, duty control thereof, etc. The valve control section controls pilot valve 43 to set an unloading pressure.

Figure 2:
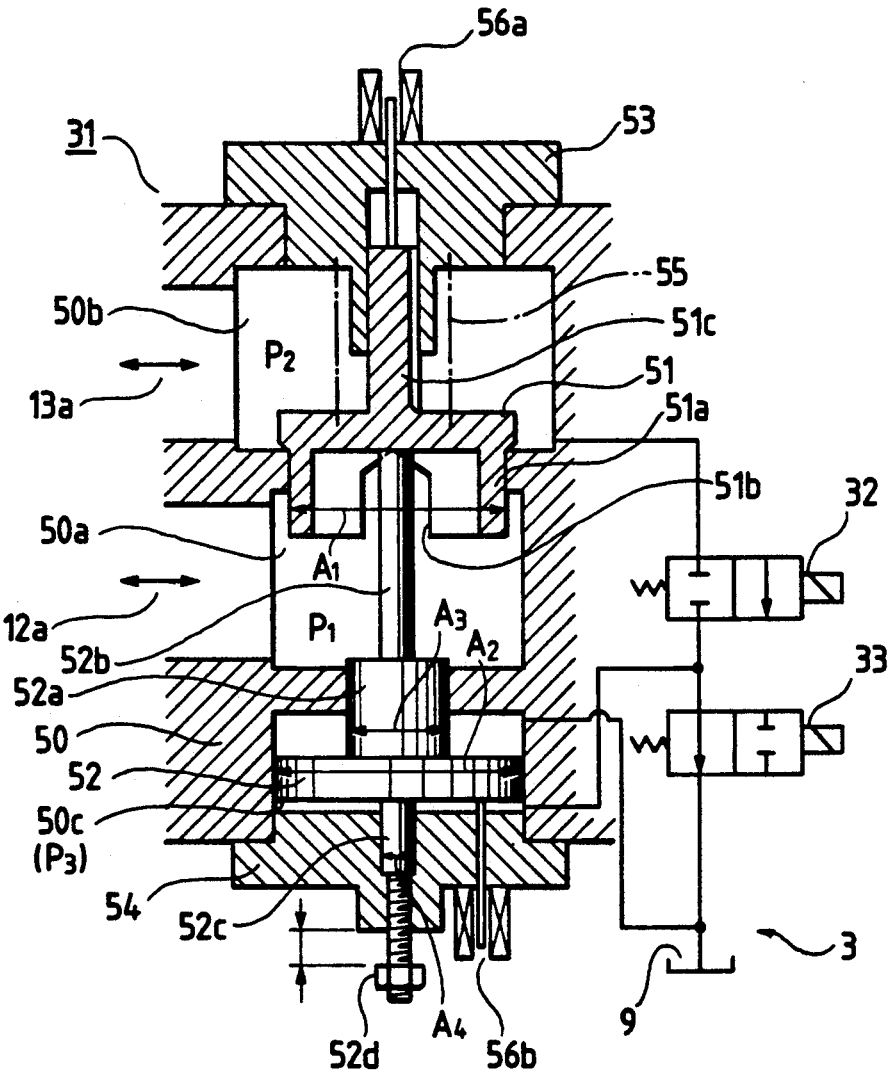
FIG. 2 is a sectional view of a control valve used in FIG. 1A.

The controller 10 receives "call" or "designation" signals from the car 2 or the elevator hall, etc., state signals such as signals of the position, speed of the car 2, and temperature and pressure of the system, and controls the pump 6 through the inverter 11 and the motor 7, the control valve 3 and the relief valve 4 so that the car 2 runs at a desired speed Referring to FIG. 2, a detailed construction of the control valve 3, in particular, the main valve 31 is shown.

The main valve 31 comprise a valve box 50 having fluid ports 12*a* and 13*a* communicating with a fluid path 12, 13, a valve body 51 disposed in the fluid path of the valve box 50 to communicate or interrupt between the fluid ports 12*a* and 13*a*, a spring 55 disposed between the valve body 51 and an end bracket 53 secured to the valve box 50 and a hydraulic actuator for actuating the valve body 51.

The valve body 51 has a skirt part 51*a* in which orifices 51*b* are formed and a valve stem 51*c* inserted in a hole formed in the bracket 53. The skirt part 51*a* and the stem 51*c* are guided by the valve box 50 and are slidable in the axial direction.

The actuator comprises a pilot chamber 50*c* formed in the valve box 50 and a piston 52 arranged so as to oppose the valve body 51 and having a piston stem part 52*a* and a piston rod part 52*b*. The piston 52 actuates the valve body 51 by fluid introduced into the pilot chamber 50*c*. The piston 52 receives fluid pressure at faces opened to the pilot chamber 50*c*, to the fluid chamber 50*a* and force through the piston rod 52*b*. The piston 52 has another piston rod 52c which is slidable in a hole formed in an end bracket 54 secured to the valve box 50.

Assuming that sectional area (A) and pressure (P) at the following parts are as follows;

A1, skirt part 51a of the valve body 51,
A2, piston 52,
A3, piston stem 52a,
A4, piston rod 52c,
P1, fluid chamber 50a,
P2, fluid chamber 50b,
P3, pilot chamber 50c, the force $F1=(A2-A4)P3$ is applied on the piston 52 on the side of the pilot chamber 50c, and the force $F2=A3P1+A1(P2-P1)+F0$ is applied ,thereon on the side of the fluid chamber 50a, wherein F0 is force of spring 55. The movement of the piston 52 is determined according to the resultant force($F=F1-F2$). If $F>0$, the piston 52 moves toward the fluid chamber 50a and if $F<0$, toward the pilot chamber 50c. If $P2=P3$, the pressure receiving surface of the piston 52 is set so that F becomes larger than 0 and the piston 52 moves toward the fluid chamber 50a.

The piston 52 is controlled by the pilot valves 32,33 to drive or actuate the valve body 51. The stopper constructed of the piston 52c and nut 52d restricts a range of movement of the valve body 51 to set an opening area of the main valve 31 which is necessary for downward operation of the car 2.

The pilot valves 32, 33 communicate and interrupt between the pilot chamber 50c and the fluid chamber 50b or between these chambers and the tank 9. The pilot valve 32 is closed to interrupt the communication between the pilot chamber 50c and the fluid chamber 50b when the solenoid is not energized, that is, at a usual time, and opened to communicate the two chambers 50c and 50b when energized, whereby fluid in the fluid chamber 50b is introduced into the pilot chamber 50c as a pilot fluid. The pilot valve 33 causes the piston chamber 50c to be opened to the tank 9 at a usual time, and the pilot chamber 50c to interrupt communication with the tank 9 when energized. During downward running of the car 2, the opening of the main valve 31 is controlled to desired opening patterns by on-off operation of the pilot valves 32, 33 which are controlled by the controller 10. A displacement detector 56a or 56b (either one is sufficient) detects the displacement of the valve body 51.

Upward and downward running of the car 2 is described hereunder.

Upward running

By an instruction output from the controller 10 according to call signals from the car 2 or the elevator hall, the pump 6 is driven through the inverter 11 and the motor 7 so that the car 2 runs upwards. The pump 6 sucks the fluid in the tank 9 through the filter 8 and discharges the fluid in the fluid path 12, whereby pressure in the fluid path 12 increases. When the pressure in the fluid path 12 becomes higher than the pressure in the fluid path 13, the fluid opens the main valve 31 and flows into the fluid path 13 and then into the cylinder 15 of the hydraulic jack 1, whereby the plunger 16 is pushed upwards. The car 2 runs upwards and is accelerated by the plunger 16 elevating. When the pump 6 reaches a rated speed, the car also comes to a rated speed. Then, the pump 6 is decelerated through a control of the inverter 11a and the motor 7 according to an instruction from the controller 10, whereby the car 2 is decelerated and stopped. Upon the stopping of the car 2, the main valve 31 is automatically closed to keep the position constant, whereby the upward running operation is finished.

Downward running:

By an instruction from the controller 10 according to signals from the car 2 or the elevator hall, the pilot valves 32, 33 are energized to introduce pilot fluid from the fluid chamber 50b into the pilot chamber 50c, whereby the piston 52 is pushed up, and the valve body 51 is pushed up by the rod 52b of the piston 52 thereby to open the main valve 31. Upon the opening of the main valve 31, the pump 6 is driven through the inverter 11 and the motor 7 so that the car runs downwards. The pump 6 sucks fluid in the hydraulic jack 1 through the flow path 13, the main valve 31 and the flow path 13 and returns the fluid into the tank 9 through the filter 8, whereby the car 2 runs by its own weight and the running is accelerated. When the pump 6 reaches to a rated speed, the car 2 also runs at a rated speed. Then the pump 6 is decelerated and then stopped through a control of the inverter 11 and the motor 7 according to an instruction from the controller 10.

At this time, the pilot valves 32, 33 are controlled so that opening of the main valve 31 is substantially proportional to the speed of the car 2. In this embodiment, the displacement detector 56a or 56b detects the position of the valve body 51, and pulse width modulation control of on-off operation of the pilot valves 32, 33 is effected referring to the position, that is, the opening. A proportional valve or valves may be employed therefor. Further, this control may be effected by a method of controlling pressure difference between the fluid chambers 50a and 50b to be constant, or a method of throttling the fluid by employing a throttle in a pilot fluid path.

After the car 2 stops, the pilot valves 32, 33 are deenergized to discharge the pilot fluid, the piston 52 is pushed downwards by the pressure of the fluid chamber 50a and the valve body 51 moved by the spring 55 in a closing direction, whereby the main valve 31 is closed, and the position of the car 2 is maintained. At this point, the downward running operation is finished.

As a starting method of downward running of the car 2, there is a method of opening the main valve 31 after balancing the pressure in the flow path 12 and the pressure in the flow path 13 by once driving the pump 6 in the upward direction before energizing the pilot valves 32, 33 and then the pump 6 is driven downwards and accelerated. After the starting, the control as mentioned above is effected. This method realizes a smooth acceleration for the car 2.

An aim of the invention is to secure safety of the hydraulic elevator in case of an emergency such as a power failure. When the car 2 runs upward, the control valve 3 functions as a check valve, so that the main valve 31 opens proportionally to a flow rate of fluid from the pump 6. When the power for driving the pump 6 stops, the fluid starts to flow in a counter direction, so that the main valve 31 is automatically closed by pressure difference between upstream side and downstream side of the valve 31 (pressure difference between in the fluid chambers 50b and 50a) and force of the spring 55, whereby the safety of passengers of the car 2 can be secured.

Figure 3:
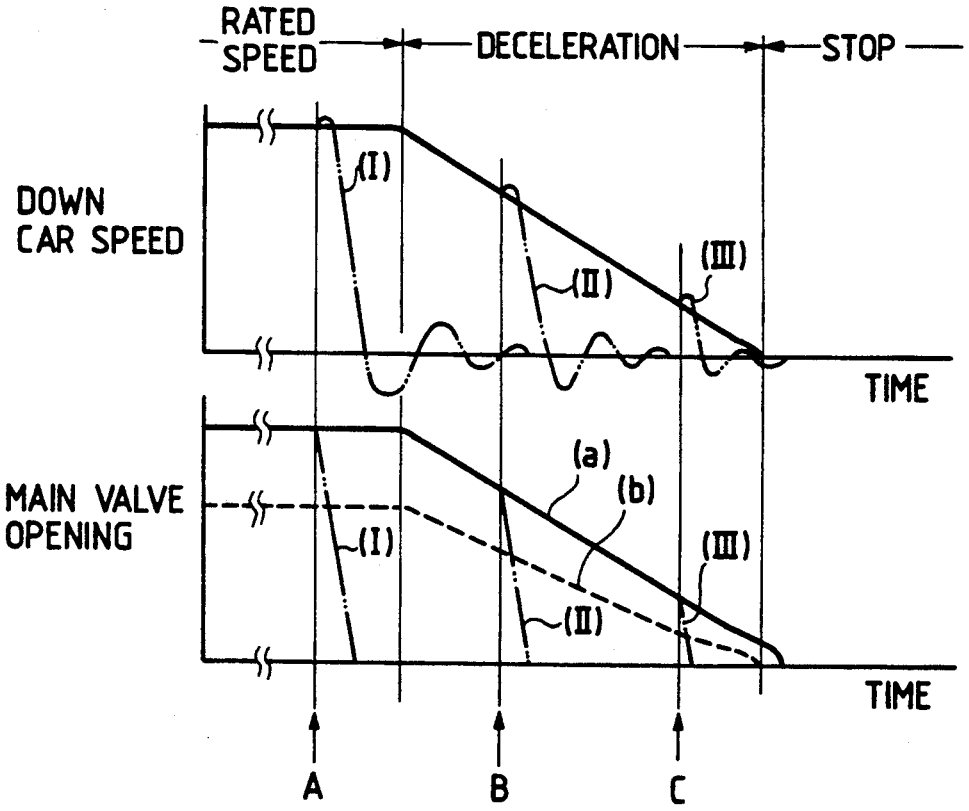
FIG. 3 is a diagram illustrated for explanation of the hydraulic elevator.

In case of downward running of the car 2, the main valve 31 is forcibly opened by the pilot valves 32, 33, so that it is necessary to move the piston 52 and the valve body 51 downwards by discharging the fluid in the pilot chamber 50c. During usual downward running, the pressure in the fluid chamber 50b and in the fluid chamber 50a balance approximately because the pump 6 operates, and force necessary to discharge the fluid in the pilot chamber 50c is force pressure applied to the stem 52a and force of the spring 55 which is relatively small. On the contrary, during an emergency, the pressure in the fluid chamber 50a is lowered abruptly, the discharge force is force pressing the piston 52 which is the pressure in the fluid chamber 50b and force of the spring 55. Therefore, the discharge force is relatively large. A relationship between opening of the main valve 31 and a speed of the car 2 from a rated speed to a stopping point is shown in FIG. 3. Namely, as the car 2 shows from the rated speed to the stopping point, the opening of the control valve 3 that is, the main valve 31 decreases as shown by a line (a). The opening is larger than a minimum valve opening (b) necessary to effect normal downward running of the car 2.

During an emergency, the pilot valves 31, 32 are deenergized. The force applied on the piston 52 which is pressure in the fluid chambers 50a, 50b and force of the spring 55 discharge the fluid in the pilot chamber 50c, whereby the main valve 31 is closed rapidly. In FIG. 3, the valve operation for an emergency occurring at each point A, B, C is shown by a dotted line (I), (II), (III). In case an emergency such as power failure occurs at A, the motor 7 has no drive force, so that the car 2 is accelerated immediately thereafter as shown by (I). However, the car 2 is rapidly decelerated and stopped since the control valve 3 is closed as shown by (I). Increment in the speed of the car 2 depends on the weight of the car 2 and a time the opening of the control valve 3 decreases from (a) to (b). In order to reduce the speed increment of the car 2 at a time the control valve 3 starts to close, it is desirable that the valve opening (a) is close to the opening (b). However, when it becomes too close, pressure loss increases, which increases the in temperature of the fluid. When an emergency occurs at B or C, a difference between the opening (a) and the opening (b) is smaller although the difference is made relatively small even when the emergency occurs at A, so that increment in speed of the car 2 is small, as shown by lines(II) and (III), and the car 2 stops rapidly. Therefore, a running distance between the position at which an emergency occurs and the position at which the car 2 stops is small. According to this embodiment, even if an emergency takes place during running of the elevator, the car 2 can be stopped rapidly, and therefore safety can be secured. Even if the car 2 is leveling, the main valve 31 can be closed rapidly since its opening is small, and a braking distance from a point the car 2 is braked to a point it stops can be shortened.

Figure 4:
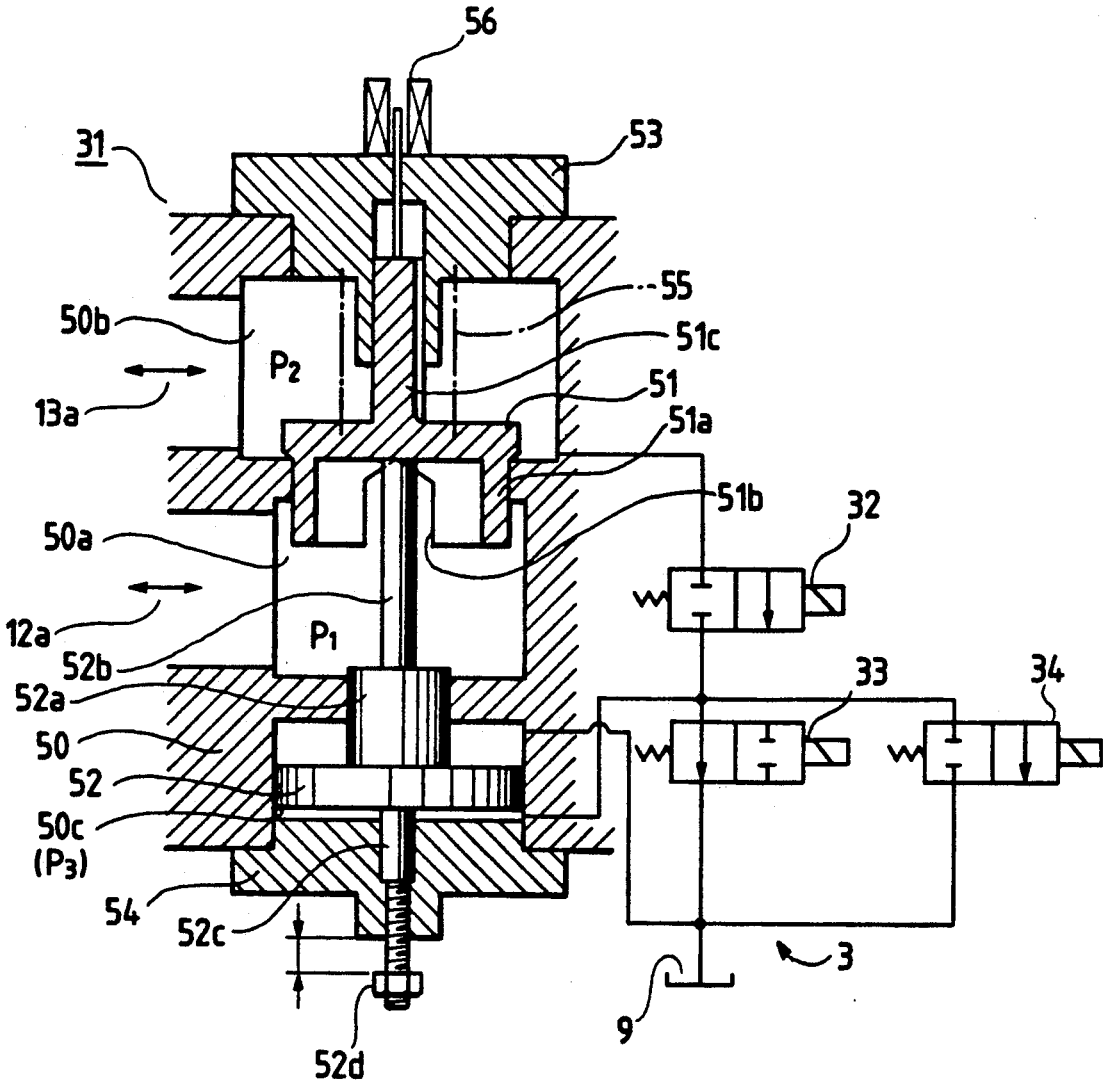
FIG. 4 is a sectional view of another embodiment of a control valve.

Another embodiment will be described, referring to FIG. 4 and 5. In FIG. 4, the same parts as in FIG. 2 have the same reference numbers given. The construction of the main valve 31 is the same as in FIG. 2, so that the explanation thereof is not given. However, another pilot valve 34 having a relatively small capacity is added, which is different from the previous embodiment. Operation for upward running is also the same in the previous embodiment, so that explanation thereof is omitted.

At a time of downward running, pilot fluid is supplied into the pilot chamber 50c by energizing the pilot valves 32, 33 to open the main valve 31, and then the pilot fluid in the pilot chamber 50c is discharged by deenergizing the pilot valves 32, 33 or by deenergizing the pilot valve 32 and energizing the pilot valves 33, 34 to close the main valve 31.

Usual closing of the main valve 31 is effected by discharging the pilot fluid from the pilot chamber 50c through the pilot valve 34, and during an emergency, the main valve 31 is closed by using the pilot valve 33. The pilot valve 34 can be made smaller in capacity than the pilot valve 33. The downward running deceleration control can be effected easily by the pilot valves 32, 33 which are subjected to duty control of on-off operation thereof, and during the emergency, a relatively large amount of the fluid is discharged rapidly to effect large downward running deceleration, so that the pilot valve 33 which is large in capacity is suitable.

Figure 5:
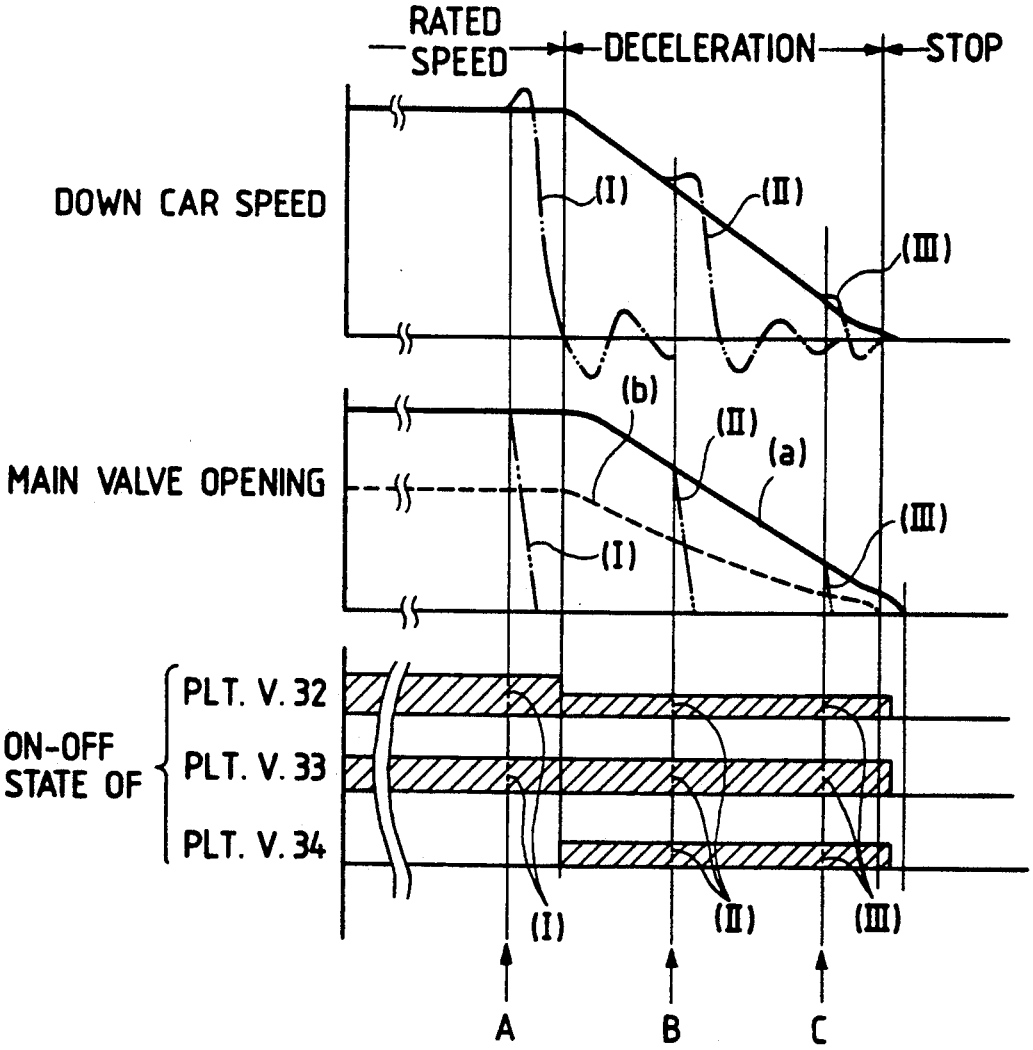
FIG. 5 is a diagram illustrated for explanation of operation of a hydraulic elevator employing the control valve in FIG. 4.

Referring to FIG. 5, an operation of the car 2 and the control valve 3 is explained for downward running of the car 2. At a time of downward running at a rated speed, the pilot valves 32, 33 are energized to push up the piston 52 thereby to open the main valve 31. At deceleration of the downward running, the pilot valve 33 remains energized (closed), and the pilot valves 32, 34 are controlled of on-off operation (its duty control) to cause the main valve 31 to close along a line (a). After the stopping of the car 2, all the pilot valves are deenergized, thereby to close the main valve 31. When an emergency takes place, all the pilot valves are also deenergized, whereby the fluid in the pilot chamber 50c is discharged through the pilot valve 33, so that the main valve 31 is closed rapidly. In the same manner as in FIG. 3, operation at an emergency occurring at A, B, C is shown by two-dotted lines (I), (II), (III). In the same manner as the previous embodiment in this case also, an increment in a running speed of the car 2 due to rapid closing of the main valve 31 is made small and a rapid stop can be effected. Even while the car 2 is leveling, the main valve 31 can be closed rapidly since the opening of the main valve 31 is small. This embodiment is provided with two pilot valves 33, 34 which are separately used for downward running stop at usual operation and at an emergency, respectively, so that closing speed of the main valve at an emergency, that is, downward running deceleration of the car 2 can be controlled easily.

Another embodiment of the invention will be described referring to FIGS. 6 to 9. The same part as in FIG. 2 are given the same reference numbers. The construction of the main valve 31 is the same as in FIG. 2. The explanation should be referred to the previous embodiment. This embodiment is provided with a throttle 32a at an upstream side of the pilot valve 32, a pilot valve 36 at an upstream side of the pilot valve 33 and a throttle 34a in a downstream side of the pilot valve 3, all of which are incorporated in the control valve 34 shown in FIG. 4.

The valve operation for the upward running is the same as in the previous embodiments.

At a time of downward running, pilot fluid is supplied into the pilot chamber 50c by energizing the pilot valve 32 to open the main valve 31, and the pilot fluid is discharged from the opposite side of the pilot chamber 50c by deenergizing the pilot valve 33 or by energizing the pilot valve 34, whereby the main valve 31 is closed. Usual closing of the main valve 31 is effected by operation of the pilot valve 34 and the closing at emergency, by the pilot valve 33. The throttle 34a arranged downstream of the pilot valve 34 controls a closing speed of the main valve 31 during usual downward running. The pilot valve 36 has a structure in which its valve opening is changeable according to the movement of the piston 52, and controls a closing speed of the main valve 31 at an emergency.

Detailed construction of the pilot valve 36 will be described referring to FIG. 7.

Figure 7:
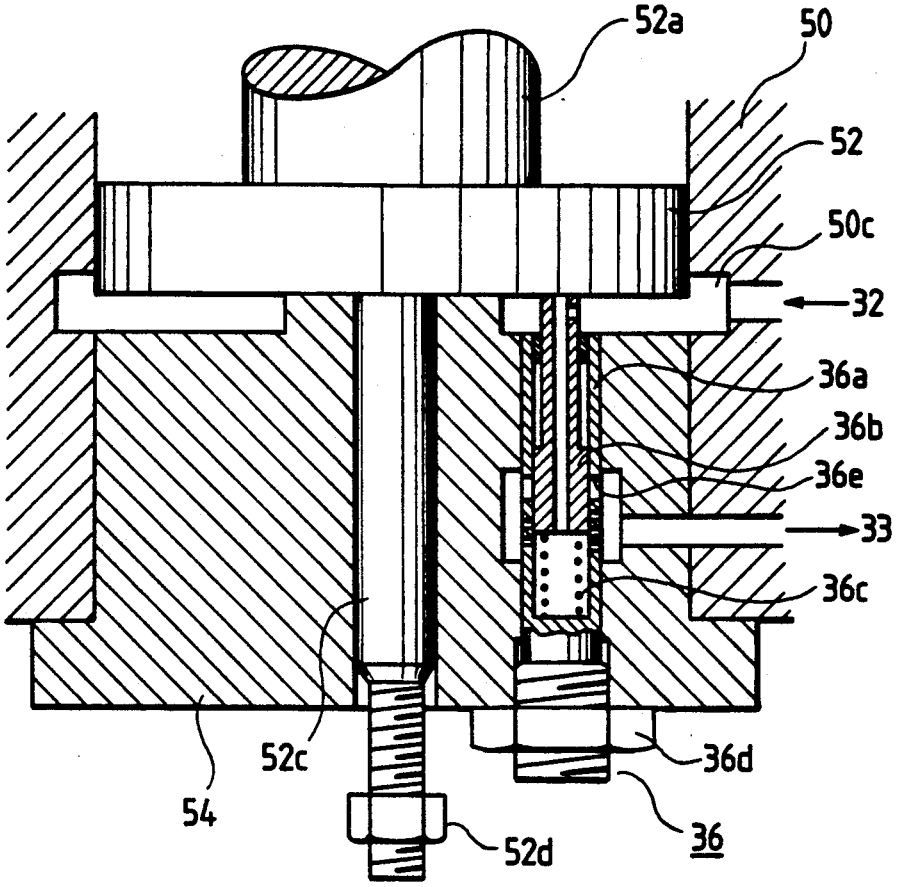
FIG. 7 is an enlarged sectional view of a part of the control valve in FIG. 6.
Figure 8:
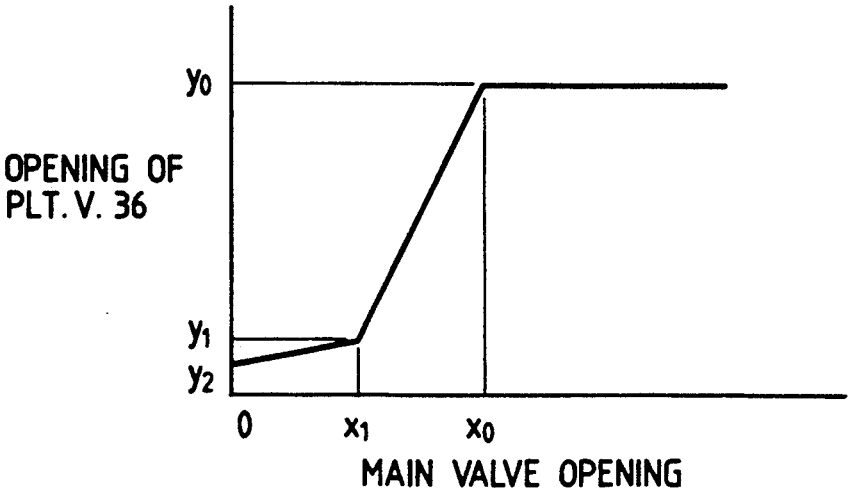
FIG. 8 is a diagram illustrated of a relationship between opening of a pilot valve 36 and opening of a main valve in the control valve in FIG. 6.

In FIG. 7, the pilot valve 36 comprises a sleeve 36*a* which is disposed in the end bracket 54 so that the position relative to the piston 52 is adjustable and has a plurality of openings 36*e* the opening area of which are larger toward the piston 52, a spool 36*b* disposed slidably in the sleeve 36*a* and having a passage therein through which the pilot valves 32 and 33 are communicable, and a spring 36*c* urging the spool 36*b* to the piston 52. As shown in FIG. 8, opening of the pilot valve 36 is set so that the opening increases gradually from $Y_2$ to $Y_1$ as the opening of the main valve changes from O to $X_1$, increases sharply from $Y_1$ to $Y_0$ as the main valve opening changes from $X_1$ to $X_0$, and becomes constant $Y_0$ when beyond $X_0$.

Figure 9:
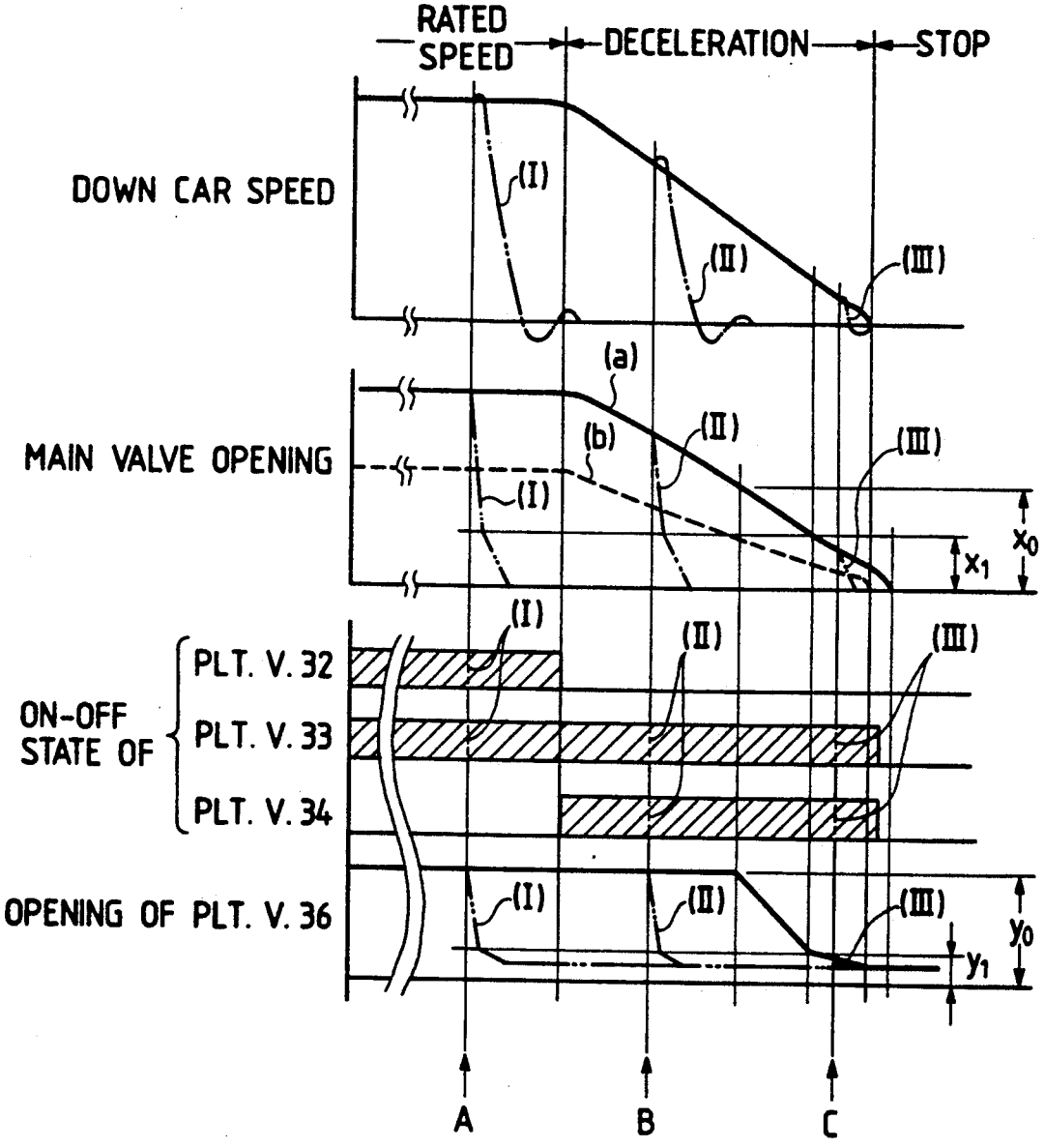
FIG. 9 is a diagram illustrated for explanation of operation of a hydraulic elevator employing the control valve in FIG. 6.

FIG. 9 shows a relationship between the car 2 and the control valve 3 from downward running of the car 2 until the car stops through deceleration, wherein the pilot valves 32, 33 and 34 are illustrated according to energized states by hatching and the opening of pilot valve 36 is shown by dotted lines.

When the car runs at a rated speed, the pilot valves 32, 33 are energized to push up the piston 52, thereby to open the main valve 31. When the car is decelerated, the pilot valve 33 remains energized, the pilot valve 32 is deenergized and the pilot valve 34 is energized, whereby the main valve 31 is operated as shown by a line(a) by a function of the throttle 34*a*. For the deceleration, it is possible to operate the main valve 31 as in the line (a) by duty control of the pilot valve 32, 34 as in FIGS. 2, 4. After the car stops, all the pilot valves are deenergized to close the main valve 31.

As apparent from FIG. 8, the opening of the pilot valve 36 changes as follows according to closing of the main valve 31, namely, when the opening of the main valve 31 changes from $X_0$ to $X_1$, the opening of the pilot valve 36 decreases relatively rapidly from $Y_0$ to $Y_1$, and when the opening of the main valve 31 decreases less than $X_1$, the opening of the pilot valve 36 is closed slowly.

When an emergency takes place, all the pilot valves are deenergized, and the fluid in the pilot chamber 50*c* is discharged via the pilot valves 36, 33 to close the main valve rapidly. The operation when an emergency occurs at A, B or C is shown by two dotted lines (I), (II), (III). In this case, as is apparent from FIG. 8, the main valve 31 is closed rapidly until the opening reaches to $X_1$ and then the valve is closed relatively slowly. Accordingly, the car 2 starts to decelerate rapidly, that is, an increment of the speed of the car 2 is small. And then, because of the slow closing of the main valve, shock is small when the car 2 stops. Further, the distance from a point the car is braked to a point the car stops is shortened.

Even if the car 2 is leveling, the main valve 31 can be closed rapidly since the opening of the main valve 31 is already made small. Further, the braking distance can be shortened because the opening of the main valve is reduced according to the speed of the car.

Figure 10:
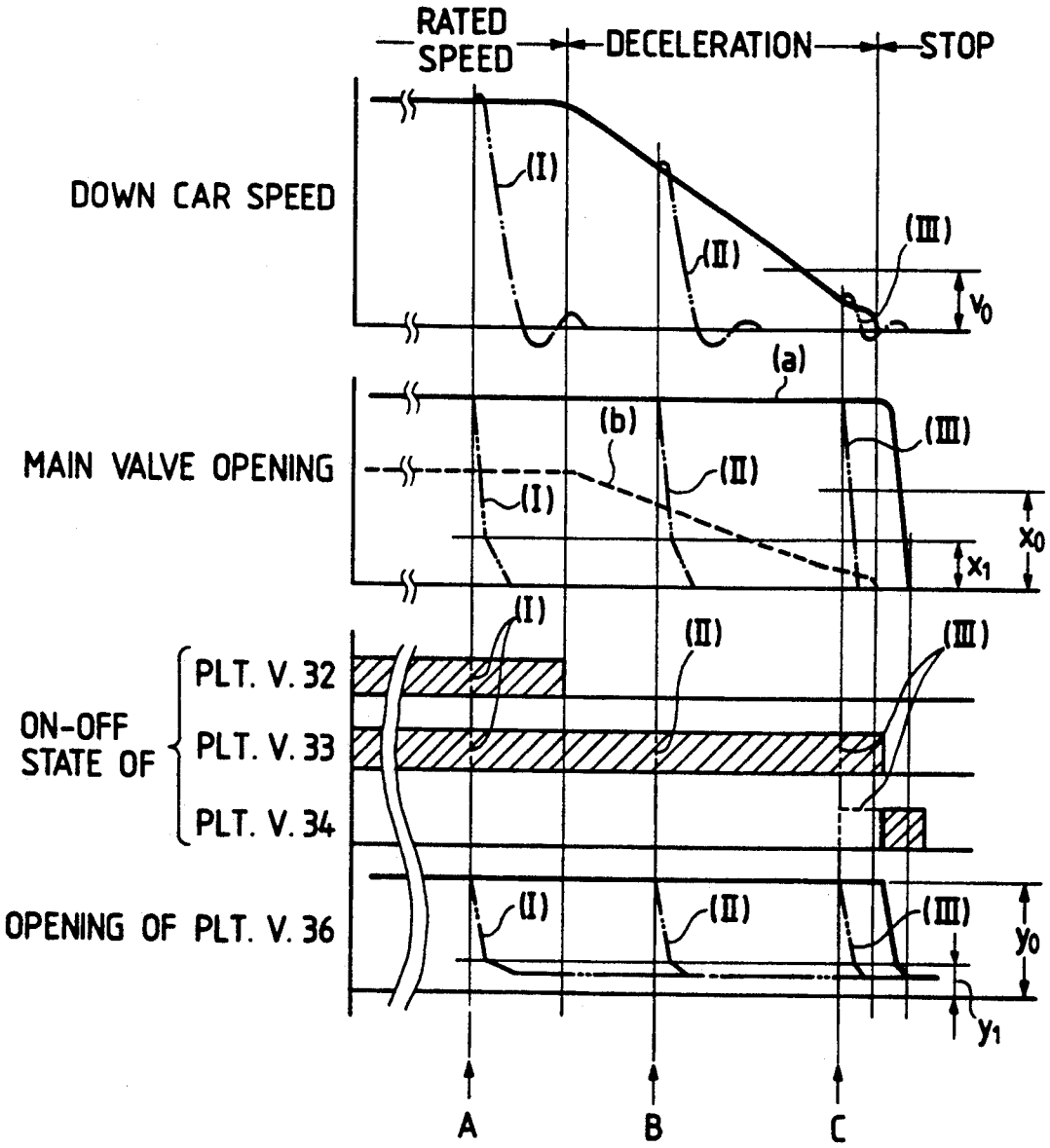
FIG. 10 is a diagram illustrated for explanation of another operation of the hydraulic elevator modified in the control valve in FIG. 6.

FIG. 10 shows operation of the hydraulic elevator having the same control valve 3 except that the throttle 34*a* is omitted. In the construction, the pilot valve 36 is the same as in FIG. 7 and a relationship between the opening of the main valve 31 and the opening of the pilot valve 36 is the same as in FIG. 8.

Upward running is the same as in the previous embodiments, so that the explanation is omitted.

In downward running, when the car 2 runs at a rated speed, the pilot valves 32, 33 are energized to open the main valve 31, and the pilot valve 32 is deenergized at deceleration to maintain the opening of the main valve 31. When the car 2 stops, the pilot valve 33 is deenergized and the pilot valve 34 is energized at the same time, whereby the main valve 31 is closed rapidly to maintain the closed position of the car 2, wherein resistance to discharge the fluid is made small although driving force of the main valve is small. A difference between FIG. 9 and FIG. 10 is in a control of the pilot valves 32,34. The throttle 34*a* can be omitted by this control.

When an emergency occurs at A, B or C, closing operation is shown by a dotted line (I), (II) or (III).

When the car 2 runs fast as at A, B, the pilot valves 32, 33 are deenergized, and the fluid in the pilot chamber 50*c* is discharged via the pilot valves 36, 33, wherein closure of the main valve 31 is changed from fast closing to slow closing. Namely, while the fluid is discharged from the pilot chamber 50*c* via the pilot valves 36, 33, the main valve 31 is closed rapidly until the opening reaches to $X_1$, and then closed slowly. Accordingly, the car 2 starts to decelerate rapidly, so that the speed increment is small. Since the main valve is closed slowly, shock of the car at its stop is small and the distance from the stoppage also can be shortened.

In case the car 2 runs at a lower speed than a predetermined one $V_0$, as shown by (III), at the same time as the pilot valves 32, 33 are deenergized, the pilot valve 34 are energized, whereby the fluid is discharged from the pilot chamber 50*c* via the pilot valves 36, 33 and 34 and the main valve 31 is closed rapidly. In this time, the fluid in the pilot chamber 50*c* is discharged via the throttle valve 34 as well as via the throttle valves 36, 33. Although the opening of the pilot valve 36 is made small, fluid resistance is small and the opening of the main valve 31 decreases at about a fixed rate since the pilot valve 34 is opened. Therefore, even if the main valve 31 requires a long stroke to be closed, it can be closed in a short time, whereby a speed increment of the car 2 is small and a braking distance is also short. Further, since the speed of the car 2 is small, braking shock is small. Even if the car 2 is leveling, the main valve 31 can be closed rapidly, so that the braking distance also is small. Here, it is necessary to set the speed $V_0$ at a value that the braking shock is small even if the main valve 31 is rapidly closed, and to provide for a power source for an emergency the capacity of which is sufficient to drive the pilot valve 34 even at power failure. It is effective for the control explained in FIG. 9 to set the speed $V_0$ to the value and to drive the pilot valve 34 with the power source, as mentioned above.

Figure 11:
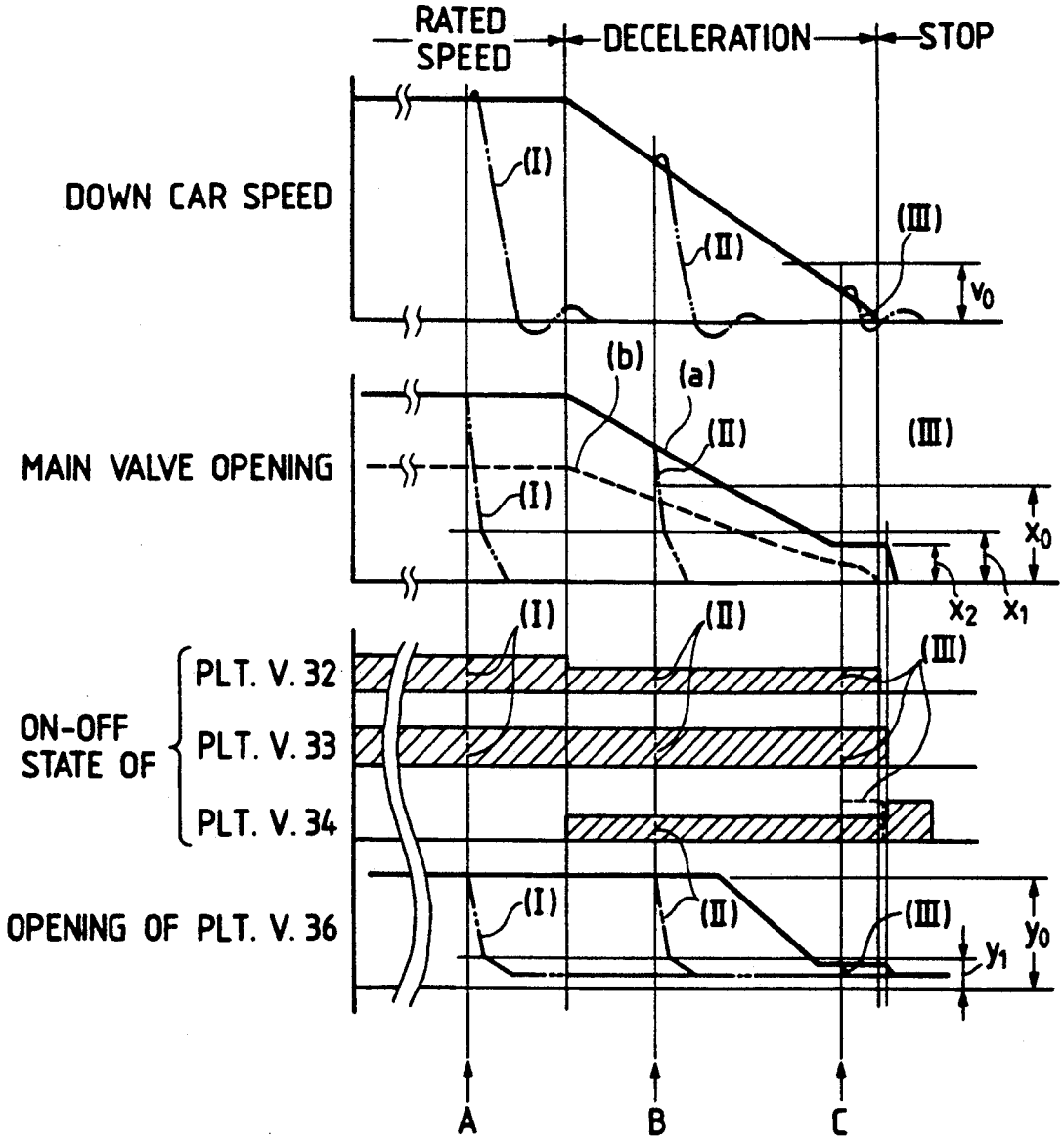
FIG. 11 is a diagram illustrated for explanation of yet another operation of the hydraulic elevator.

Referring to FIG. 11, another control of the hydraulic elevator will be explained, wherein the control valve 3 according to this embodiment is the same as in FIG. 6 except that the throttle 34*c* is omitted. The embodiment is explained referring to FIGS. 6 to 8 and 11. Since upward running of the car 2 is the same as in the previous embodiments, explanation thereof is omitted.

When the car 2 runs downwards at a rated speed, the pilot valves 32, 33 are energized to push up the piston 52, thereby to open the main valve 31. At deceleration, the pilot valve 33 remains energized, and the pilot valves 32,34 are controlled(for example, a control of duty ratio of the pilot valves 32, 34 being in on-off operation, which is shown in FIG. 11 by reduced height in hatched portion) to operate the main valve 31 as shown by (a). In this case, the main valve 31 is controlled in the same manner as in FIG. 2, however, when displacement or opening of the main valve 31 reaches to $X_2$, the opening is maintained. After the car 2 stops, the pilot valve 32, 33 are deenergized, and the pilot valve 34 is fully opened, whereby the main valve 31 is closed rapidly and the car 2 keeps the position fixed.

Operation in case an emergency occurs at A, B or C is shown by a dotted line (I), (II), (III). When the car 2 runs fast as shown by (I), (II), all the pilot chamber 32, 33, 34 are deenergized, the fluid in the pilot valve 50c is discharged via the pilot valves 36, 33 and the main valve 31 is closed while changing a closing rate thereof from high to low by making use of throttling change of the pilot valve 36. Namely, in the same manner as in FIG. 8, the main valve is closed rapidly until the opening reaches to $X_1$, and then closed relatively slowly. Therefore, the car 2 starts to decelerate rapidly, so that speed increment of the car 2 is small, and then the main valve 31 is closed slowly, so that shock at the stoppage of the car 2 is small and a running distance from the braking to the stoppage also is small.

In case the car 2 runs at a lower speed than a predetermined speed ($V_0$), as shown by (III), the fluid in the pilot chamber 50c is discharged via the pilot valves 36, 33, 34 by deenergizing the pilot valves 32, 33 and opening fully the pilot valve 34 at the same time, whereby the main valve 31 is closed rapidly. At this time, the fluid in the pilot chamber 50c is discharged via the pilot valve 34 in addition to the pilot valves 36,33. Therefore, the opening of the pilot valve 36 becomes small, however, fluid resistance is small because the pilot valve 34 is opened and the opening of the main valve 31 decreases at substantially constant rate. Additionally, a stroke for closing the main valve 31 is short, so that the main valve 31 is closed in a short time. Further, a speed increment of the car 2 is small, a braking distance is short and the braking shock also is small because the speed of the car 2 is small. The main valve 31 can be closed rapidly even during leveling of the car 2, whereby the braking distance can be shortened. Here, it is necessary to set the speed $V_0$ in a range in which the braking shock is small even when the main valve 31 is closed rapidly and to provide for a power source for an emergency the capacity of which is enough to drive the pilot valve 34 even at a power failure.

Figure 6:
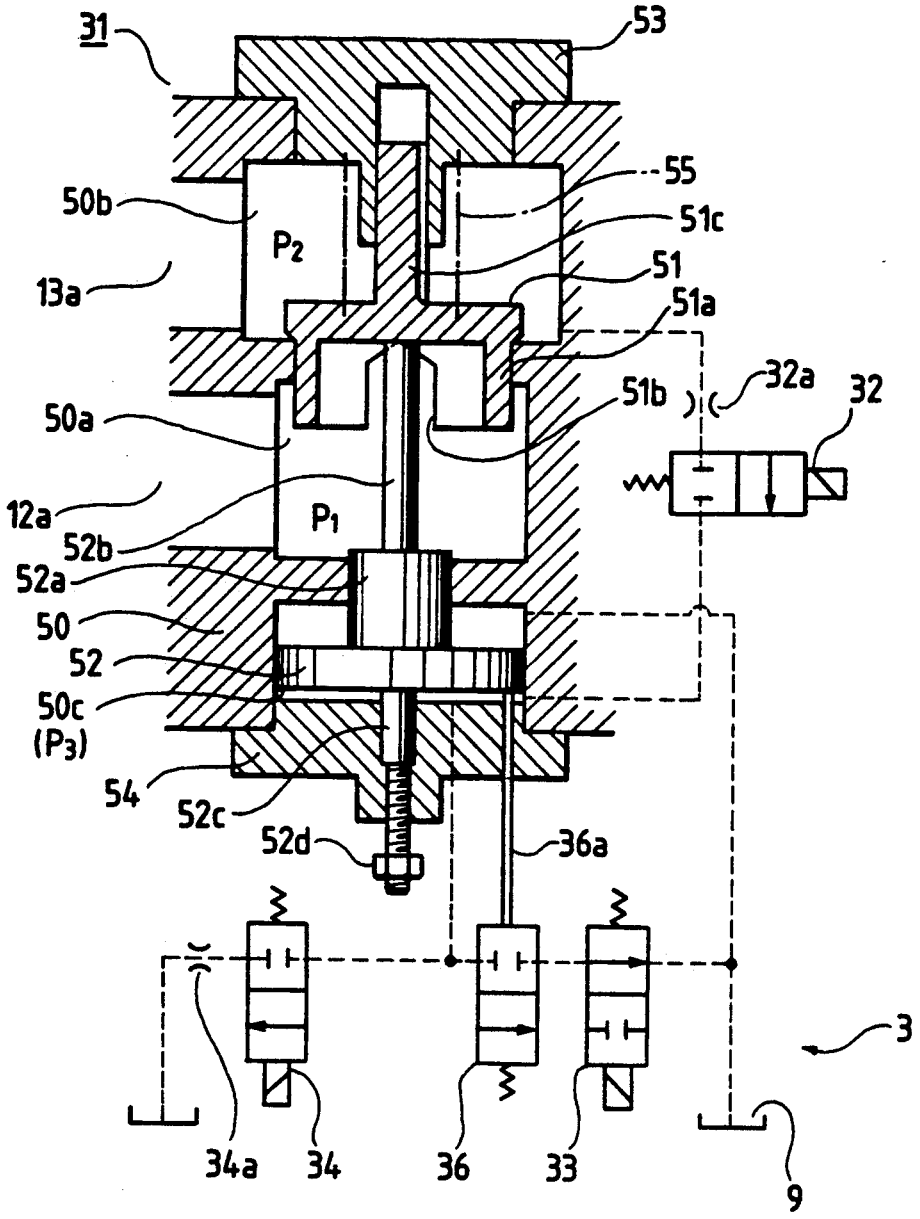
FIG. 6 is a sectional view of another embodiment of a control valve.
Figure 12:
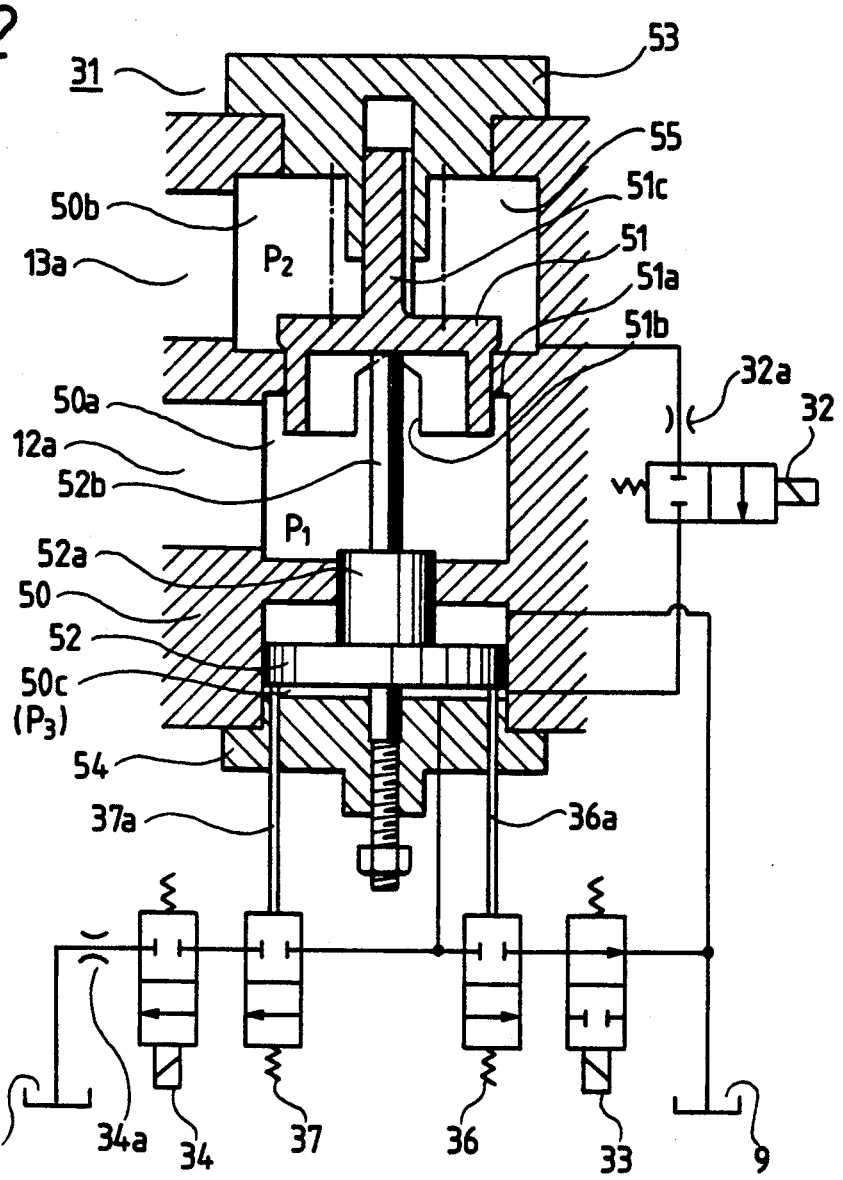
FIG. 12 is a sectional view of another embodiment of a control valve.
Figure 13:
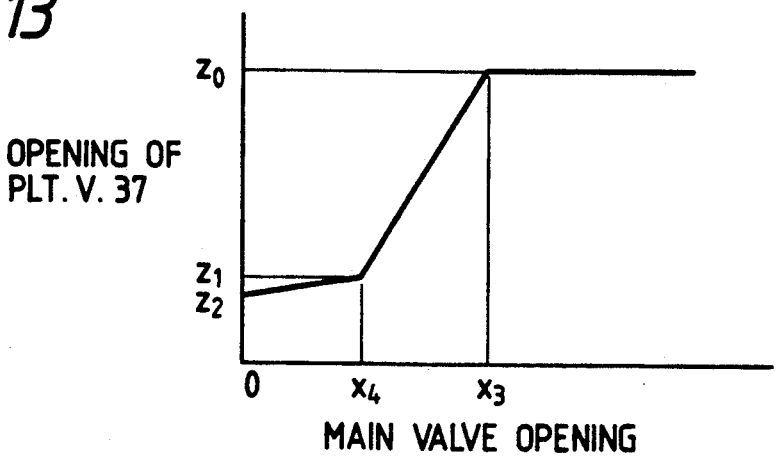
FIG. 13 is a diagram illustrated of a relationship between opening of a pilot valve 37 and opening of a main valve.

FIG. 12 shows another embodiment of a control valve 3 which is similar to one in FIG. 6, but has another pilot valve 37 with sleeve 37a disposed in the fluid path between the pilot chamber 50c and the pilot valve 34, and changeable of its throttle quantity depending on the movement of the piston 52 in the same manner as the pilot valve 36. The construction of the pilot valve 37 is the same as the pilot valve 36. A relationship between the opening of the main valve 31 and the pilot valve 37 is shown in FIG. 13. Namely, the opening of the pilot valve 37 increases gradually from $Z_2$ to $Z_1$ as the opening of the main valve changes from O to $X_4$, increases sharply from $Z_1$ to $Z_0$ as the main valve 31 changes from $X_4$ to $X_3$, and becomes a fixed opening $Z_0$ when the opening of the main valve 31 is larger than $X_3$. Upward running of the car 2 is the same as previous embodiments, so that the explanation thereof is omitted.

Figure 14:
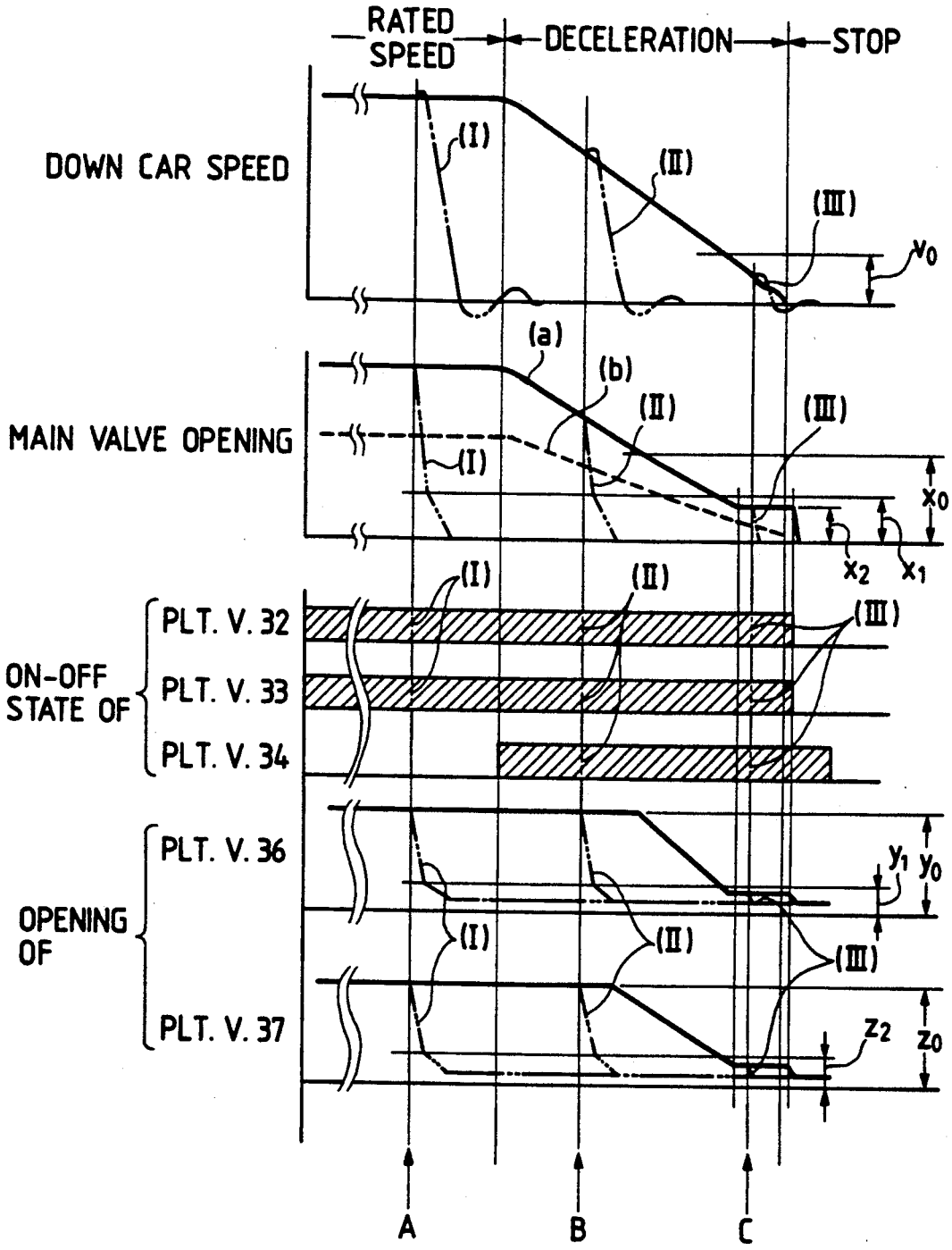
FIG. 14 is a diagram for explanation of operation of a hydraulic elevator employing the control valve in FIG. 12.

Operation of the car 2 and the control valve 3 at downward running is shown in FIG. 14. In FIG. 14, when the car 2 runs at a rated speed, the pilot valves 32, 33 are energized to push up the piston 52 thereby to open the main valve 31. When the car 2 is decelerated, the pilot valves 32, 33 remain energized, and the pilot valve 34 is energized, whereby the main valve 31 is operated as shown by (a) by making use of a relation between the throttles 32a, 34a and throttle of the pilot valve 37. Namely, when the opening of the pilot valve 37 is large, the throttles 32a, 34a are adjusted so that the main valve 31 is closed depending on a difference between the fluid quantity flowing into the pilot chamber 50c from the pilot valve 32 and the fluid quantity flowing out therefrom via the pilot valve 34. When the main valve 31 is closed gradually and the opening of the pilot valve 37 becomes small, fluid resistance at the outflow side increases and the quantity of fluid flowing in and the quantity of fluid flowing out are balanced, so that the main valve 31 stops once at the opening $X_2$. After the car 2 stops, the pilot valves 32, 33 are deenergized and the pilot fluid is discharged from the pilot valve 34, whereby the main valve 31 is closed, and the car 2 keeps the position fixed. After the main valve 31 is closed, the pilot valve 34 is deenergized.

Operation at an emergency occurring at A, B or C is shown by a two dotted line (I), (II), or (III). In this case, all the pilot valves 32, 33, 34 are deenergized and the fluid in the pilot chamber 50c is discharged via the pilot valves 36, 33, whereby the main valve 31 is closed. In case the car 2 runs fast as shown by (I), (II), the main valve 31 is changed from the opening having a high rate to a low rate by making use of change in throttling degree of the pilot valve 36, and closed. When the car 2 runs at a speed lower than a predetermined speed $V_0$ as in (III), the fluid in the pilot chamber 50c is discharged via the pilot valve 36,33 to close the main valve 31. Accordingly, the car 2 starts to decelerate and stops. At this time, since the opening of the pilot valve 36 is relatively small, the main valve 31 is closed slowly, however, a running distance necessary to stop is relatively short because the opening of the main valve 31 is small.

Figure 15:
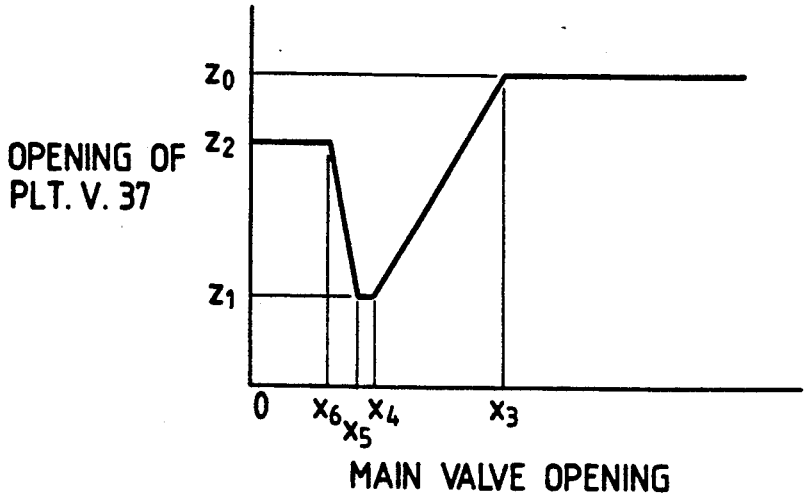
FIG. 15 is a diagram illustrated of another relationship between opening of the pilot valve 37 and the main valve.
Figure 16:
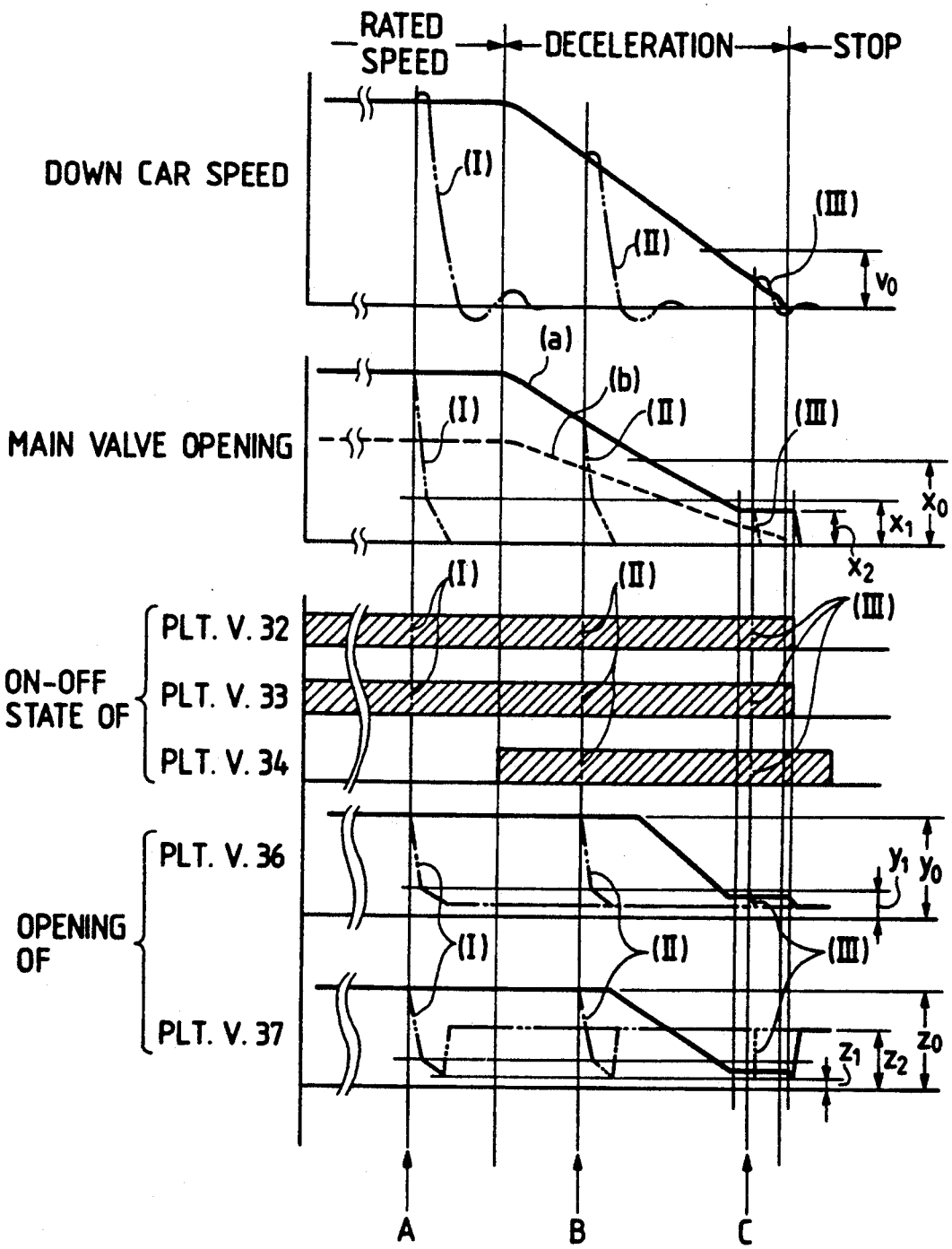
FIG. 16 is a diagram illustrated for explanation of another operation of the hydraulic elevator.

Even in the case the car runs at a lower speed than the predetermined speed $V_0$ as in (III), if a rapid closing of the main valve 31 is desired, the opening of the pilot valve 37 decreases as the main valve is decreased in opening as shown in FIG. 15, and then increase when it is less than $X_5$. At the same time as this operation, in the case (III) in which the speed of the car 2 is lower than the predetermined speed $V_0$, as shown in FIG. 16 deenergization of the pilot valve 34 is delayed. Accordingly, the opening of the pilot valve 37 decreases once, and the opening of the main valve 31 is kept at $X_2$, thereafter, when the opening of the main valve 31 decreases further, the opening of the pilot valve 37 increases and it becomes easy to discharge the pilot fluid, so that the main valve can be opened rapidly. Therefore, a speed increment of the car 2 is small, a braking distance is short, and the speed of the car 2 around stoppage thereof is small, so that shock occurring at braking is small. Since the main valve 31 can be closed rapidly even if the car 2 is in leveling, the braking distances can be shortened. It is necessary that the speed $V_0$ is set to be in a range in which braking shock is small even if the main valve 31 is closed rapidly, and an electric power of the capacity enough to drive the pilot valve 34 even during a power failure emergency.

Figure 17:
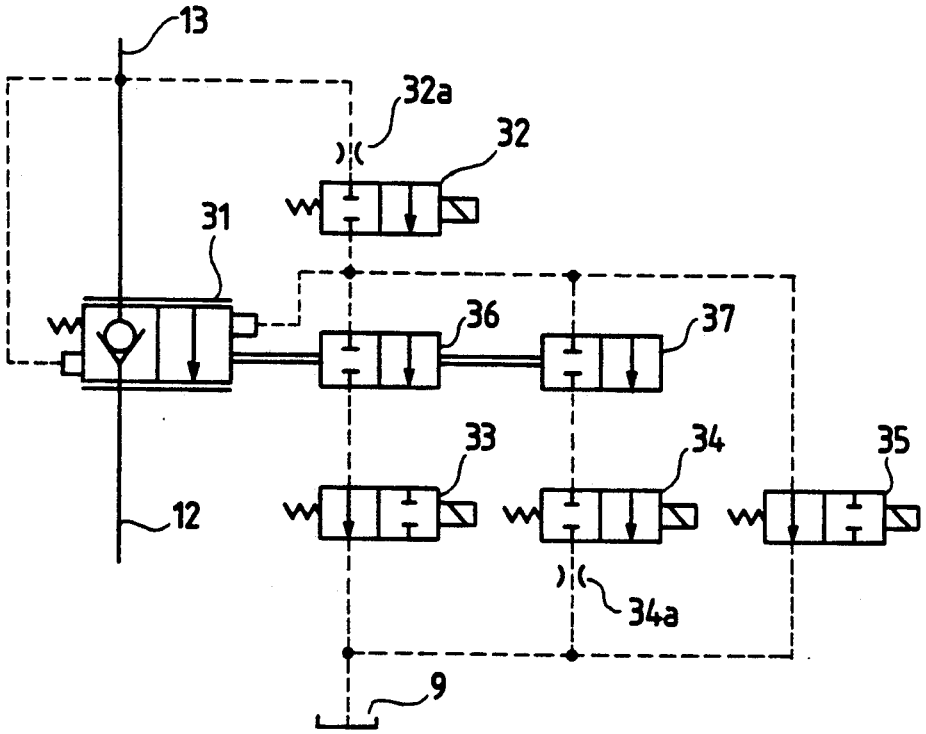
FIG. 17 is a schematic diagram of another embodiment.

FIG. 17 is a construction of FIG. 12 to which a pilot valve 35 is added in parallel to a fluid path between the pilot chamber 50c and the tank 9. Under usual down running, by an operation instruction, the pilot valve 35 is energized, and then the pilot valves 32, 33, 34 are controlled as shown in FIG. 12. In this case, the pilot valve 35 always interrupts a fluid path, so that usual downward running is practiced as shown in FIG. 14. When an emergency takes place, the pilot valves 32, 33, 34 are deenergized, which is the same as the previous embodiments, and the pilot valve 35 is controlled according to the speed of the car 2. Namely, in case of A, B in FIG. 14, an energized state is maintained, and the state is released in case of C, whereby the car 2 is decelerated and stops at A, B, as shown in FIG. 14. Therefore, a running distance after the emergency takes place is short and shock at stoppage is small. In case the car runs at a slow speed as in C, the pilot fluid can be discharged from the pilot chamber 50c via the pilot valve 35 in parallel with the pilot valves 36, 33, so that the main valve can be closed more rapidly than in the embodiment in FIG. 12. This means that the braking distance can be extremely shortened, and safety in such a case that an emergency occurs during correction of the position of the car 2 is further increased.

Many different embodiments of the present invention may be constructed without departing from the spirit and scope of the invention. It should be understood that the present invention is not limited to the specific embodiments described in this specification.

What is claimed is:

1. A hydraulic elevator comprising:

a car;

a hydraulic jack connected to said car to drive said car;

a hydraulic pump fluidly communicable with said hydraulic jack;

a control means for controlling a flow rate of fluid flowing to or from said hydraulic jack to thereby control movement of said car, wherein said control means comprises:

a main valve provided in a fluid path between said hydraulic pump and said hydraulic jack and constructed so as to be hydraulically opened to allow fluid from said hydraulic pump to flow into said hydraulic jack when a pressure of the fluid in the fluid path between said hydraulic pump and said main valve is greater than a fluid pressure in the fluid path between said main valve and said hydraulic jack thereby to effect upward running of said car, and to check a fluid flow from said hydraulic jack to said hydraulic pump when fluid pressure in the fluid path between said hydraulic pump and said main valve is less than the fluid pressure in the fluid path between said main valve and said hydraulic jack;

valve control means for controlling, when the pressure of the fluid in the fluid path between said hydraulic pump and said main valve is less than the fluid pressure in the fluid path between said main valve and said hydraulic jack, said main valve to open and close, said valve control means including actuating means for actuating said main valve, and a plurality of pilot valves hydraulically connected to said actuating means and the fluid path between said main valve and said hydraulic jack for controlling fluid supply to and fluid discharge from said actuating means; and means for controlling said plurality of pilot valves to control said actuating means so as to effect the closing operation of said main valve in at least two different closing rate patterns.

2. A hydraulic elevator according to claim 1, wherein one of said at least two different closing rate patterns operates to control the closing operation of said main valve under emergency conditions so that a closing rate thereof changes at a predetermined opening so that the closing rate after reaching the predetermined opening is lower than the closing rate before reaching the predetermined opening.

3. A hydraulic elevator according to claim 1, wherein said main valve is closed at at least two closing rates during closing of said main valve when said car runs at a high sped, and at one closing rate when said car is idle.

4. A hydraulic elevator comprising:

a car;

a hydraulic jack connected to said car to drive said car;

a hydraulic pump fluidly communicable with said hydraulic jack;

control means for controlling a flow rate of fluid flowing to or from said hydraulic jack to thereby control movement of said car, wherein said control means comprises:

a main valve provided in a fluid path between said hydraulic pump and said hydraulic jack and constructed so as to be hydraulically opened to allow fluid from said hydraulic pump to flow into said hydraulic jack when a pressure of the fluid in the fluid path between said hydraulic pump and said main valve is higher than a fluid pressure in the fluid path between said main valve and said hydraulic jack thereby to effect upward running of said car, and to check a fluid flow from said hydraulic jack to said hydraulic pump when the fluid pressure in the fluid path between said hydraulic pump and said main valve is less than the fluid pressure in the fluid path between said main valve and said hydraulic jack; and valve control means, including means for actuating said main valve, and a plurality of pilot valves hydraulically connected to said actuating means and the fluid path between said main valve and said hydraulic jack for controlling fluid supply to and fluid discharge from said actuating means, for controlling, when the fluid pressure in the fluid path between said hydraulic pump and said main valve is less than the fluid pressure in the fluid path between said main valve and said hydraulic jack, said main valve to open to thereby effect downward running of said car and to close so as to reduce an opening of said main valve as a speed of the downward running of said car decreases.

5. A hydraulic elevator according to claim 4, wherein said valve control means further includes means for controlling said pilot valves to control the opening degree of said main valve during the downward running of said car to provide a reduced opening larger than a minimum opening of said main valve necessary to effect a desired downward running speed of said car.

6. A hydraulic elevator according to claim 4, wherein said valve control means includes means for closing said main valve at a rapid speed from said reduced opening thereof under emergency conditions.

7. A hydraulic elevator according to claim 6, wherein said valve control means further includes means for controlling said pilot valves to close said main valve at at least two closing rates under the emergency conditions by said pilot valves.

8. A hydraulic elevator according to claim 4, wherein said main valve during downward running declaration of said car is closed at a rate substantially proportional to the downward running deceleration.

9. A hydraulic elevator comprising:

a car;

a hydraulic jack connected to said car to drive said car;

hydraulic pump fluidly communicable with said hydraulic jack;

a main valve mounted on a fluid path between said hydraulic jack and said hydraulic pump and having a valve body constructed so as to be opened by a fluid pressure in said fluid path between said main valve and said hydraulic pump when said fluid pressure in the fluid path between said main valve and said hydraulic pump is greater than the fluid pressure in the fluid path between said main valve and said hydraulic jack, to thereby effect upward running of said car, and closed when the fluid pressure in the fluid path between said main valve and said hydraulic pump is lower than the fluid pressure in the fluid path between said main valve and said hydraulic jack, said main valve having an actuator incorporated therein for actuating said valve body; and valve control means including a plurality of pilot valves fluidly connected to said actuator and said fluid path between said main valve and said hydraulic jack, for controlling, when the fluid pressure in the fluid path between said main valve and said hydraulic pump is lower than the fluid pressure in the fluid path between said main valve and said hydraulic jack, said actuator so that opening of said main valve decreases as a downward running speed of said car decreases.

10. A hydraulic elevator according to claim 9, wherein said actuator comprises a pilot chamber and a piston disposed therein for actuating said valve body of said main valve, and wherein said pilot valves include a first pilot valve disposed in a first passage fluidly connecting said pilot chamber and said fluid path between aid main valve and said hydraulic jack, and a second pilot valve disposed in a second passage fluidly connecting said pilot chamber and said fluid path between said main valve and said hydraulic jack, and a second pilot valve disposed in a second passage fluidly connecting said pilot chamber and a tank, said first and second pilot valves opening and closing said first and second passages, respectively, whereby said actuator controls movement of said valve body by a pilot fluid introduced into or discharged from said pilot chamber.

11. A hydraulic elevator according to claim 10, wherein a third pilot valve is further included in parallel to said second pilot valve, one of said second and third pilot valves having a larger fluid flow quantity to be controlled thereby than the other and being for an emergency and the other for an operation other than the emergency.

12. A hydraulic elevator according to claim 10, wherein said pilot valves further include an opening-changeable pilot valve which is opening-changeable thereof at two different opening rates according to the opening of said main valve, the opening of said opening-changeable pilot valve changing at a larger opening change rate when the opening of said main valve is larger than a predetermined value, and at a smaller opening change rate when the opening of said main valve is smaller than said value.

13. A hydraulic elevator according to claim 11, further including a fourth pilot valve disposed in said second passage upstream of said second pilot valve, said fourth pilot valve being opening-changeable thereof so that the opening changes at a greater rate of speed when the opening of said main valve is larger than a predetermined value and at a smaller rate of speed when the opening of said main valve is less than said predetermined value, whereby a rapid closing operation of said main valve is effected at the two different rates.

14. A hydraulic elevator according to claim 13, wherein said first passage upstream of said first pilot valve and said second passage downstream of said third pilot valve, each include a throttle.

15. A hydraulic elevator according to claim 13, wherein a fifth pilot valve is disposed in parallel to said fourth pilot valve, said fifth pilot valve being opening-changeable thereof according to an opening of said main valve.

16. A hydraulic elevator comprising:

a car;

a hydraulic jack connected to said car to drive said car;

a hydraulic pump fluidly communicable with said hydraulic jack;

a control valve including a main valve mounted on a fluid path between said hydraulic jack and said hydraulic pump and having a valve body constructed so as to be opened by a fluid pressure in the fluid path between said main valve and said hydraulic pump when the fluid pressure in the fluid path between said main valve and said hydraulic pump is higher than fluid pressure in the fluid path between said main valve and said hydraulic jack, to thereby effect upward running of said car, and closed when the fluid pressure in the fluid path between said main valve and said hydraulic pump is lower than the fluid pressure in the fluid path between said main valve and said hydraulic jack, and an actuator disposed in a pilot chamber and actuated by fluid introduced therein for actuating said valve body; and valve control means, including a plurality of pilot valves fluidly connected to said actuator and the fluid path between said main valve and said hydraulic jack, for controlling said actuator to actuate said valve body when the fluid pressure in the fluid path between said main valve and said hydraulic pump is lower than the fluid pressure in the fluid path between said main valve and said hydraulic jack, thereby to control downward running of said car;

wherein said pilot valves control pilot fluid flow supplied to and discharged from said pilot chamber; and wherein said control valve is constructed so that the fluid flow supplied to said pilot chamber is balanced with the fluid flow discharged from said pilot chamber once during closing of said main valve.

17. A hydraulic elevator according to claim 16, wherein said valve control means further included means for changing an opening of one of said pilot valves according to the opening of said main valve.

18. A hydraulic elevator according to claim 17, wherein said control valve has a valve in which a fluid flow rate quantity is changed according to movement of said valve body, said valve having an increased opening as the opening of said main valve decreases, and increases during a closed state of said main valve.

19. A control method of a hydraulic elevator having a car, a hydraulic jack to drive said car, a hydraulic pump, a main valve mounted on a fluid path between said hydraulic pump and said hydraulic jack to be opened when a first pressure of fluid in the fluid path between said hydraulic pump and said main valve is higher than a second fluid pressure in the fluid path between said main valve and said hydraulic jack to run said car upward and closed when the first fluid pressure is less than the second fluid pressure to effect downward running of said car, an actuator connected to said main valve to drive said main valve and a plurality of pilot valves connected to said actuator and the fluid path between said main valve and said hydraulic jack to control the main valve during the downward running of the car, said control method comprising the steps of:

opening said main valve through operation of the pilot valves to effect downward running of said car;

controlling fluid flow from said hydraulic jack by controlling said hydraulic pump to effect downward running of said car;

closing said main valve in different closing rate patterns according to the downward running speed at which said car is to be stopped through operation of said pilot valves.

20. A control method according to claim 19, wherein the main valve is closed, in one of said different closing rate patterns so as to have a greater closing rate until the opening of said main valve reaches a predetermined opening and a slower closing rate after reaching said predetermined opening, under emergency conditions when the car runs at a higher speed, and closed in the other closing rate pattern so as to be at a fixed rate when the car runs at a lower speed.

21. A control method according to claim 19, wherein the opening of the main valve decreases substantially proportionally to deceleration of said car.

22. A control method according to claim 20, wherein the main valve is closed at a fixed speed when said car is idle.

23. A control method of a hydraulic elevator having a car, a hydraulic jack to drive the car, a hydraulic pump, a main valve mounted on a fluid path between said hydraulic pump and said hydraulic jack to be opened when a first fluid pressure in the fluid path between said hydraulic pump and said main valve is higher than a second fluid pressure in the fluid path between said main valve and said hydraulic jack to run said car upward and closed when the first fluid pressure is less than the second fluid pressure to effect downward running of said car, an actuator connected to said main valve to drive said main valve and a plurality of pilot valves connected to said actuator and said fluid path between said main valve and said hydraulic jack to control the main valve during the downward running of said car, said control method comprising the steps of:

opening the main valve through operation of the pilot valves to effect downward running of said car;

controlling fluid flow from said hydraulic jack by controlling said hydraulic pump to effect downward running of said car;

reducing the opening of said main valve by an operation of said pilot valves so that reduced opening of said main valve is larger than a minimum opening necessary to allow said car to effect the downward running controlled by said hydraulic pump; and closing said main valve around a position at which said car is stopped through operation of said pilot valves.

24. A hydraulic elevator according to claim 1, wherein said valve control means further includes means for changing an opening of one of said plurality of pilot valves according to the opening of said main valve.

25. A hydraulic elevator according to claim 24, wherein said valve control means further includes means for changing an opening rate of said opening changeable pilot valve at a predetermined opening of said main valve so that said opening rate is larger when the opening of said main valve is larger than said predetermined opening than that when the opening of said main valve is smaller than said predetermined opening.

26. A hydraulic elevator according to claim 1, wherein said actuating means comprises a pilot chamber and a piston disposed therein for actuating said main valve, and wherein said pilot valves include a first pilot valve disposed in a first passage fluidly connecting said pilot chamber and said fluid path between said main valve and said hydraulic jack, and further pilot valves mounted on a passage between said pilot chamber and a fluid tank, said further pilot valves including a second pilot valve connected to said piston and being opening-changeable hereof according to an opening of said main valve.

27. A hydraulic elevator according to claim 26, wherein said further pilot valves include a third pilot valve provided at a downstream side of said second pilot valve, and a fourth pilot valve provided in parallel to said second and third pilot valves.

* * * * *